United States Patent [19]

Sundberg

[11] Patent Number: 4,936,331

[45] Date of Patent: Jun. 26, 1990

[54] DISPENSER ARRANGEMENT FOR A LIQUID TREATMENT AGENT IN A DISH-WASHER

[75] Inventor: Lars-Erik Sundberg, Jönköping, Sweden

[73] Assignee: Aktiebolaget Electrolux, Stockholm, Sweden

[21] Appl. No.: 350,606

[22] Filed: May 11, 1989

[30] Foreign Application Priority Data

May 30, 1988 [SE] Sweden ..... 8802012

[51] Int. Cl.[5] ..... A47L 15/44

[52] U.S. Cl. ..... 134/201; 68/17 R; 134/99

[58] Field of Search ..... 134/93, 100, 99, 201; 68/17 R; 222/361, 362, 651; 312/278, 279

[56] References Cited

U.S. PATENT DOCUMENTS 2,254,269 9/1941 Clark et al. ..... 222/361 X
2,664,904 1/1954 Stokes et al. ..... 134/93 X
3,207,373 9/1965 Dannenmann ..... 222/651
3,370,597 2/1968 Fox ..... 134/100 X
4,784,168 11/1988 Erminio ..... 134/100

FOREIGN PATENT DOCUMENTS 3403622 8/1985 Fed. Rep. of Germany ..... 68/17 R

*Primary Examiner*—Philip R. Coe
*Attorney, Agent, or Firm*—Pearne, Gordon, McCoy & Granger

[57] ABSTRACT

A dish-washer comprises a cabinet (11), with a cleansing chamber (14). The chamber is closed by a door which sealingly cooperates with a sealing area (20) arranged on the cabinet and surrounding the cleansing chamber. A dispenser (24) for a liquid treatment agent is arranged in a recess (23) or the like in the cabinet (11) separated from the cleansing chamber (14) and so situated that the dispenser is accessible for re-filling the treatment agent from the door side of the machine in an area situated in the same plane as the sealing area (20) but radially outside it. The outlet (26) of the dispenser communicates with the cleansing chamber (14) by means of a tube (27) or the like.

3 Claims, 1 Drawing Sheet

DISPENSER ARRANGEMENT FOR A LIQUID TREATMENT AGENT IN A DISH-WASHER

BACKGROUND OF THE INVENTION

This invention relates to a dispenser arrangement for a liquid treatment agent in a dish-washer.

Dispensers for wetting agents in dish-washers usually comprise a container with a refill opening as well as an outlet. Dosing the agent is effected by means of a piston activated by electricity and feeding the desired amount of the agent to the cleansing chamber via the outlet. In dish-washers which are placed on the floor, the dispenser is often arranged in the door of the machine which means that the inlet opening for the agent in easily accessible when the door is opened. A drawback is however that the dispenser is placed in the cleansing chamber which means that the re-fill opening has to be closed by a cover which is sealed by annular ring or the like.

In dish-washers being placed on the sink it is desirable to avoid electrical installations in the door and in this type of machines the dispenser has been arranged at the rear wall of the cleansing chamber. As in machines which are placed on the floor the re-fill opening of the dispenser has to be covered by a tight cover. In this case the re-fill opening is not easily accessible but re-filling has to take place inside the machine at its rear wall. In order to facilitate the re-fill operation the bottle containing the agent has been provided with an extended re-fill pipe.

SUMMARY OF THE INVENTION

The purpose of this invention is to create a dispenser arrangement eliminating the drawbacks mentioned above. According to the invention re-filling takes place at the door-side of the machine and the dispenser is electrically operated without arranging the elctrical conductors in the door. The purpose is achieved with a dispenser arrangement having the characteristics mentioned in the introduction which, according to the invention, is characterized by a dispenser arranged in a recess in the cabinet so that it is accessible for refilling from the door side of the machine and in communication with the cleaning chamber.

BRIEF DESCRIPTION OF THE DRAWINGS

One embodiment of the invention will now be described in detail with reference to the accompanying drawing.

DETAILED DESCRIPTION OF THE PREFERRED EMBODIMENT

Figure 1:
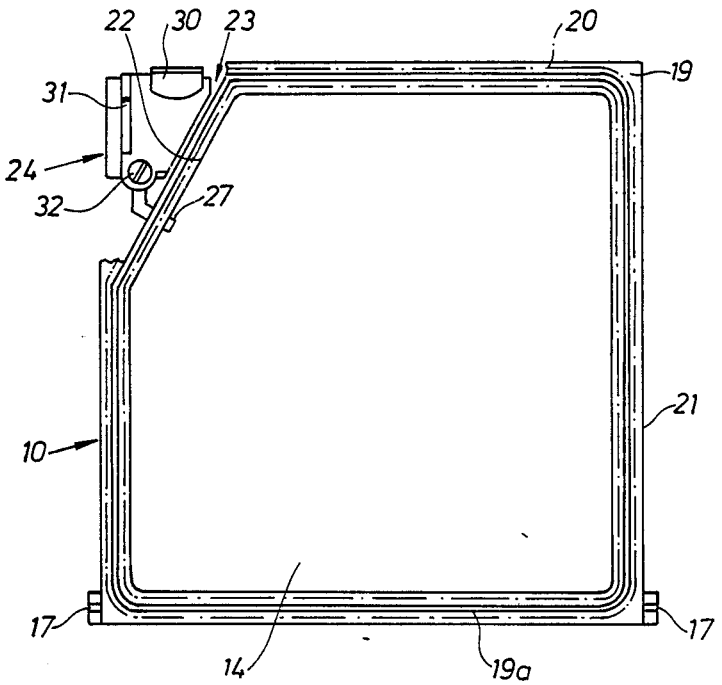
FIG. 1 shows schematically a dishwasher cabinet seen from the front and with the door taken away.
Figure 2:
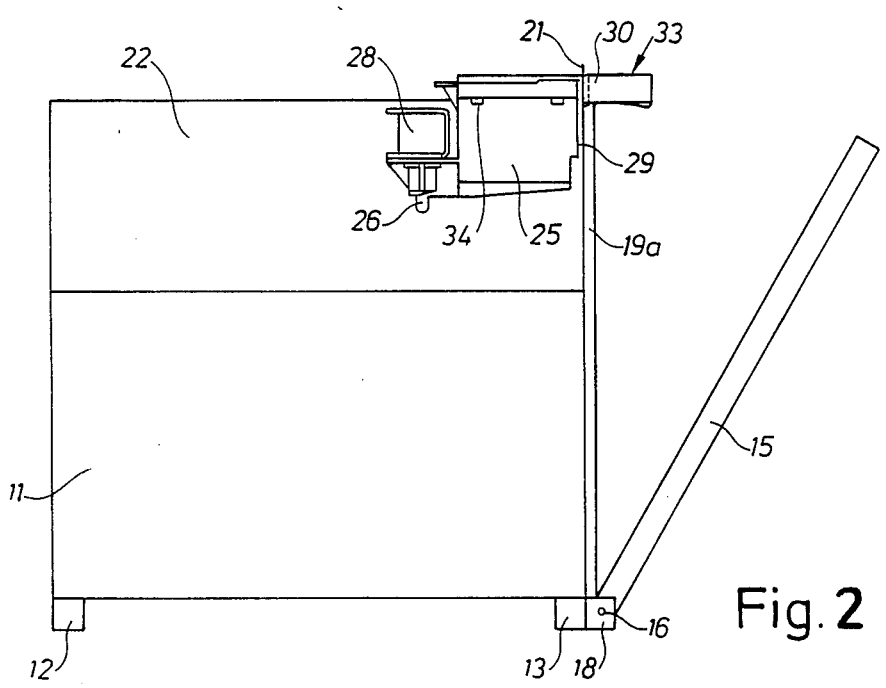
FIG. 2 is a side view of the cabinet according to FIG. 1 but with the door in its partially opened position.

The dish-washer 10 comprising a cabinet 11 resting on two transverse support beams 12, 13 and enclosing a cleansing chamber 14 with a front opening. The opening can be closed by means of a rectangular door 15 which by taps 16 is turnably supported in holes 17 arranged in bearing parts 18 fastened to the support beam 13 and positioned on each side of the cabinet. In closed position the door cooperates with a sealing rim **19*a* attached to a vertical surface 19 surrounding the opening of the cleansing chamber. The sealing rim 19*a* is preferably of rubber and extends around the opening in a sealing area 20. The cabinet, as seen from the front side, has a generally seen rectangular shape but with one of the upper corners being obliquely cut. The surface 19 is a part of an edge flange 21 on the cabinet. As appears from FIG. 1 the periphery of the edge flange 21 has a shape which corresponds to the periphery of the door so that the closed door completely covers the surface 19**.

As appears from FIG. 1 the cleansing chamber 14 also has a generally rectangular shape. The upper left corner is however replaced by an inclined surface 22 which extends in the deep direction along the complete side of the cabinet. In this manner a space or recess 23 is created where a dispenser 24 for a liquid treatment agent such as a detergent or a wetting agent is placed. The cleansing chamber is provided with upper and lower extensible racks, not shown, for supporting the dishes. The support means on the racks for the plates are preferably placed so that the plates are mainly parallel with the rear wall at the left hand side of the cleaning chamber. This means that the corner area radially outside the plates which normally is a free space in effectively used. The dispenser comprises a container 25 which is wedge shaped in order to fit in the recess. In the rear part of the container there is an outlet 26 which via a short tube 27 is connected to the cleansing chamber. The tube is inserted into a sleeve shaped connecting part, not shown, in the wall of the cleansing chamber and sealed by annular sealing, not shown. Above the outlet 26 a solenoid 28 is arranged which acts on a piston or the like, not shown, arranged for feeding a fixed amount of the agent from the container 25 to the cleansing chamber.

The dispenser is fastened at the cabinet partly by the tube 27 and partly because a front surface 29 of the container by means of screws or in any other way is fastened to the flange 21. In the flange there are openings or recesses for an extensible re-fill spout 30, an amount indicator 31 and a turnable nob 32 for setting the desired amount to be fed. The amount indicator comprises a transparent vertical pipe communicating with the inside of the container. The height of the liquid column in the pipe indicates the amount of liquid in the container. The re-fill spout 30 comprises a horizontal tube or an upwardly open channel which at its front end has a re-fill opening 33 and at its rear end has a downwardly directed outlet 34. The re-fill spout is movable between an extended position for re-filling and a retracted normal position. In the retracted position the door can be closed and in this position the door completely covers the dispensing arrangement.

I claim:

1. In a dispenser arrangement for a liquid treatment agent in a dishwasher, said dishwasher comprising a cabinet (11) enclosing a cleansing chamber (14), said cleansing chamber having an open end closed by a door (15) which sealingly cooperates with a sealing area (20) on said cabinet surrounding said open end of said cleansing chamber, said sealing area being generally in the same plane as a front of the cabinet; and a dispenser (24) arranged in a recess (23) in said cabinet (11) separated from said cleansing chamber (14), such that said dispenser is accessible for refilling of a liquid treatment agent from the door side of the machine in an area which is in the same plane as, but radially outside, said sealing area (20), said dispenser (24) having an outlet which communicates with said cleansing chamber by means of a connecting tube (27), the improvement wherein said door (15) is situated at the front of the cabinet (11) and has a rectangular shape, said cabinet (11) as viewed from said door (15) also having a generally rectangular shape but with one of the upper corners being obliquely cut for forming the recess (23) for the dispenser (24), said door (15) being so arranged that, in its closed position, it covers the cleansing chamber (14) as well as the dispenser (24).

2. A dispenser arrangement according to claim 1, wherein the dispenser (24) comprises a container (24) with a re-fill opening (33) which is arranged at one end of a movable connecting part (30) having a generally planar front surface, the other end of which opens into the container (25) whereby the planar front surface of said connecting part (30) can be placed in a first position generally parallel to, but situated at a distance from, the front of the cabinet (11) and a second position in which the planar front surface of said connecting part (30) is generally in the same plane as the front of the cabinet.

3. A dispenser arrangement according to claim 2, wherein the connecting part (30) is an extensible re-fill spout.

* * * * *

UNITED STATES PATENT AND TRADEMARK OFFICE

CERTIFICATE OF CORRECTION

PATENT NO. : 4,936,331

DATED : June 26, 1990

INVENTOR(S) : Lars-Erik Sundberg

It is certified that error appears in the above-identified patent and that said Letters Patent is hereby corrected as shown below:

Column 1, line 15, delete "in" and insert --is--;

line 19, after "by" (second occurrence) insert --an--.

Column 2, line 2, delete "seen";

line 22, delete "in" and insert --is--.

Column 3, line 11, delete "(24)" and insert --(25)--.

Signed and Sealed this

Twenty-seventh Day of August, 1991

*Attest:*

HARRY F. MANBECK, JR.

*Attesting Officer*

*Commissioner of Patents and Trademarks*